US005469013A

United States Patent [19]

Kang

[11] Patent Number: 5,469,013

[45] Date of Patent: Nov. 21, 1995

[54] LARGE DISCHARGE-VOLUME, SILENT DISCHARGE SPARK PLUG

[75] Inventor: Michael Kang, Los Alamos, N.M.

[73] Assignee: The United States of America as represented by the United States Department of Energy, Washington, D.C.

[21] Appl. No.: 41,020

[22] Filed: Mar. 31, 1993

[51] Int. Cl.[6] ..... H01T 13/20

[52] U.S. Cl. ..... 313/138; 313/128; 313/130; 313/141; 313/143

[58] Field of Search ..... 313/138, 118, 313/128, 130, 141, 143, 131 R, 131 A; 123/169 EL

[56] References Cited

U.S. PATENT DOCUMENTS

| | | | |
|---|---|---|---|
| 1,905,957 | 4/1933 | Anderson | 313/131 R |
| 2,168,206 | 8/1939 | Hastings | 313/131 R |
| 3,890,518 | 6/1975 | Tombs | 313/138 |
| 4,301,782 | 11/1981 | Wainwright . | |
| 4,926,088 | 5/1990 | Kler | 313/141 |

OTHER PUBLICATIONS

Baldur Eliasson et al., "Nonequilibrium Volume Plasma Chemical Processing," IEEE Transactions on Plasma Science 19, No. 6, 1067–1077 (1991).

Manabu Higashi et al., "Soot Elimination and $NO_x$ and $SO_x$ Reduction in Diesel–Engine Exhaust by a Combination of Discharge Plasma and Oil Dynamics," IEEE Transactions on Plasma Science 20, NO. 1, 1–11 (1992).

*Primary Examiner*—Sandra L. O'Shea
*Assistant Examiner*—Vip Patel
*Attorney, Agent, or Firm*—Samuel M. Freund; William Eklund; William R. Moser

[57] ABSTRACT

A large discharge-volume spark plug for providing self-limiting microdischarges. The apparatus includes a generally spark plug-shaped arrangement of a pair of electrodes, where either of the two coaxial electrodes is substantially shielded by a dielectric barrier from a direct discharge from the other electrode, the unshielded electrode and the dielectric barrier forming an annular volume in which self-terminating microdischarges occur when alternating high voltage is applied to the center electrode. The large area over which the discharges occur, and the large number of possible discharges within the period of an engine cycle, make the present silent discharge plasma spark plug suitable for use as an ignition source for engines. In the situation, where a single discharge is effective in causing ignition of the combustible gases, a conventional single-polarity, single-pulse, spark plug voltage supply may be used.

2 Claims, 2 Drawing Sheets

LARGE DISCHARGE-VOLUME, SILENT DISCHARGE SPARK PLUG

BACKGROUND OF THE INVENTION

The present invention relates generally to spark plugs for igniting fuel/air mixtures and, more particularly, to a silent discharge plasma ignition apparatus. The invention was made with government support under Contract No. W-7405-ENG-36 awarded by the U.S. Department of Energy. The government has certain rights in the invention.

A "lean-burn" engine is one that uses a stoichiometric fuel-air mixture. That is, a mixture is introduced into the cylinders where there is exactly sufficient oxygen present to oxidize the fuel completely. Currently, much richer mixtures are employed in vehicles. One reason for this relates to the fuel/air mixing process itself; that is, no known mixing process can thoroughly mix gases at the molecular level, especially when the turbulence is as low as it is for engine speeds at idle. Stratification generally occurs, and for a stoichiometric mixture, a single spark, albeit one having long duration, is insufficient to ensure formation of a stably propagating flame front. This results in engine misfires; an engine which is running "rough."

Alternative ignition systems employ multiple pulse drivers to drive conventional spark plugs. However, only a few pulses are generated per cylinder firing cycle, and the plugs fire at the same location for each pulse.

Barrier-discharge cells having an electrode gap of several millimeters and operating at ambient pressure generate microdischarges which are distributed uniformly (spatially and temporally) throughout the cell's discharge volume. See, e.g., Baldur Eliasson et al., "Nonequilibrium Volume Plasma Chemical Processing," IEEE Transactions on Plasma Science 19, no. 6, 1063–1077 (1991); and Manabu Higashi et al., "Soot Elimination and $NO_x$ and $SO_x$ Reduction in Diesel-Engine Exhaust by a Combination of Discharge Plasma and Oil Dynamics," IEEE Transactions on Plasma Science 20, no. 1, 1–11 (1992). Such cells are used in plasma chemistry where the discharge spatial density is important to ensure uniform chemistry throughout the gas mixture. An example is the industrial production of ozone for municipal water treatment. It is undesirable to operate these cells significantly above ambient atmospheric pressure, since the microdischarge spatial density becomes increasingly nonuniform with increase in pressure.

Accordingly, it is an object of the present invention to provide a high discharge volume, multiple microdischarge ignition system.

Another object of the invention is to provide an ignition system having self-terminating microdischarges.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the spark plug having a large ignition volume hereof may include a generally cylindrical, grounded first electrode, an elongated second electrode surrounded by a dielectric barrier material and located axially to the first electrode, whereby an annular volume is created therebetween, and means for providing sufficient voltage to the second electrode such that self-terminating microdischarges occur between the dielectric material and the first electrode through the annular volume.

It is preferred that the first electrode have an open structure in the region surrounding the annular volume.

In a further aspect of the present invention, in accordance with its objects and purposes the spark plug hereof includes a grounded, generally cylindrical first electrode, an elongated second electrode located axially to the first electrode, the first electrode having a dielectric barrier located on the interior surface thereof, whereby an annular volume is created between the second electrode and the dielectric barrier material, and means for providing sufficient voltage to the second electrode such that self-terminating microdischarges occur between the second electrode and the dielectric material through the annular volume.

Benefits and advantages of the invention include increased probability of a microdischarge occurring in the vicinity of a fuel-air mixture having sufficient fuel to initiate ignition, and reduced electrode erosion since the microdischarges are self-terminating.

BRIEF DESCRIPTION OF THE DRAWINGS

The accompanying drawings, which are incorporated in and form a part of the specification, illustrate two embodiments of the present invention and, together with the description, serve to explain the principles of the invention. In the drawings:

FIGS. 1*a* and 1*b* are schematic representations of a first embodiment of the present invention, illustrating an axial electrode with surrounding dielectric barrier material extending into the open-structured portion of a grounded, second electrode, FIG. 1*a* showing a cross section thereof, while FIG. 1*b* shows more clearly the conducting wire coil embodiment of the open-structured portion attached to a portion of a threaded section.

FIGS. 2*a* and 2*b* are schematic representations of a second embodiment of the present invention, illustrating an open axial electrode located substantially within a solid, second electrode which is shielded therefrom by a cylindrical dielectric material barrier, FIG. 2*a* showing a cross section thereof, while FIG. 2*b* shows a portion of a threaded section and the dielectric material portion emerging therefrom.

DETAILED DESCRIPTION OF THE INVENTION

Briefly, the present invention includes a generally spark plug-shaped arrangement of a pair of electrodes, where either of the two coaxial electrodes is substantially shielded by a dielectric barrier from a direct discharge from the other electrode, the unshielded electrode and the dielectric barrier forming an annular volume in which self-terminating microdischarges occur. The large area over which the discharges occur, and the large number of possible discharges within the period of an engine cycle, make the silent discharge plasma spark plug of the invention suitable for use as an ignition spark plug for engines.

Figure 1A:
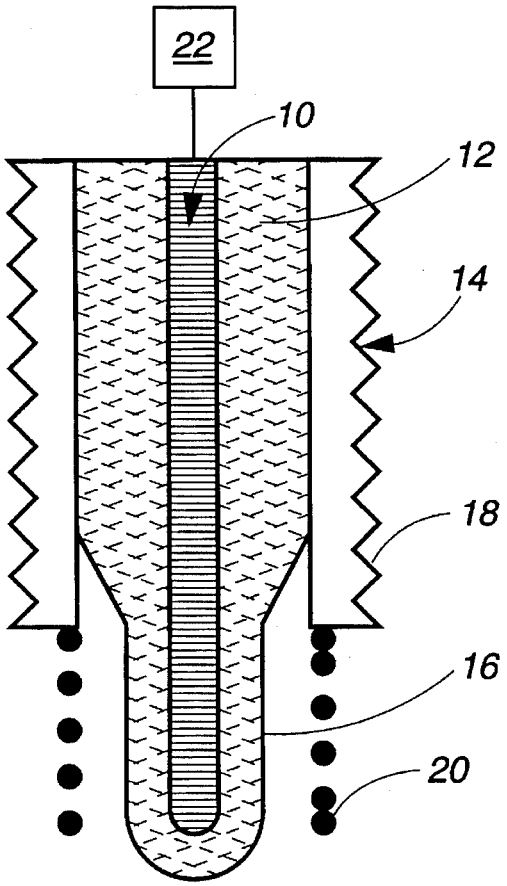
Figure 1B:
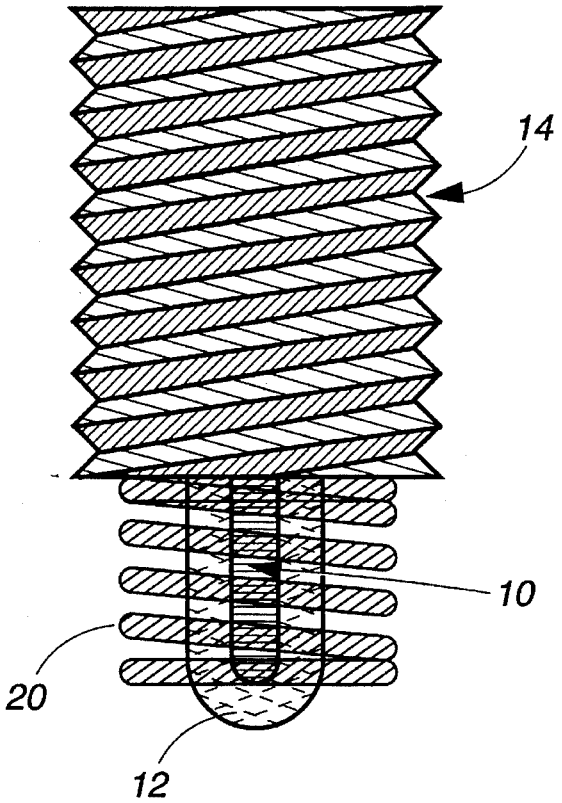

Reference will now be made in detail to the present preferred embodiments of the invention, examples of which are illustrated in the accompanying drawings. Turning now to the drawings, similar or identical structures therein will be identified using identical callouts. FIGS. 1*a* and 1*b* are schematic illustrations of a first embodiment of the invention, FIG. 1*a* showing a cross section, while FIG. 1*b* shows part of the outer structure of the spark plug. The geometry shown is generally cylindrical, principally since it is desirable to introduce the spark plugs of the present invention into existing engines, and to provide electric field enhancement, thereby permitting the plugs to operate at high gas pressures while requiring only modest voltages. Other geometries generally require higher voltages to initiate a discharge for the same gas pressure. Center electrode 10 is enclosed by dielectric barrier material 12, and in cooperation with grounded, cylindrical electrode 14 forms discharge volume 16. Electrode 14 includes screw portion 18 which is adapted to fit existing engine spark plug holes, and open cage-like portion 20. Alternating high voltage is supplied to center electrode 10 by means of voltage supply 22. The spark plug of the present invention is capable of generating numerous, self-terminating microdischarges during the course of a cylinder cycle. These discharges occur in a random manner throughout discharge volume 16, which greatly increases the probability of the overlap between a microdischarge and a pocket of fuel/air mixture having sufficient fuel to initiate ignition. Conventional ignition systems employ multiple-pulse drivers which generate but a few pulses per cylinder cycle, and the plugs fire within small ignition volume each time. Moreover, electrode erosion is expected to be of significantly less importance than that observed in currently used spark plugs, since each microdischarge is self-terminating; that is, the charge transferred per unit area is small, and the effective electrode area is much larger. The average electrical power requirement of the spark plug of the present invention is expected to be approximately 100 W.

Open cage 20, shown in FIGS. 1*a* and 1*b*, is a simple conducting wire coil and illustrates one embodiment for achieving a discharge volume which is readily accessed by the gas to be ignited. Other embodiments might include a number of spaced-apart conducting rods, disposed parallel to center electrode 10, and attached to screw portion 14, perhaps with connecting conducting rods perpendicular thereto and forming a cage structure. The wound wire configuration (shown) 20 has a long thermal conduction path to screw threads 18, and may not be useful in all applications.

A sealed cell having the configuration shown in FIGS. 1*a* and 1*b* hereof was operated at 18 kV ac with 135 psig of dry air between 1 Hz and several kHz. The pressure chosen approximates that in a typical gasoline engine cylinder during the compression cycle. Center electrode 10 and dielectric barrier 12 included a glass tube (10 mm inside diameter, 2 mm wall thickness) filled with fine steel wool. A coil spring was employed as grounded electrode 20 and provided a 1 mm discharge gap 16 around the dielectric barrier. The glass dielectric barrier failed after several minutes of operation. However, with the large number of ceramic materials currently available, locating a suitable dielectric barrier material should not present a problem.

Figure 2A:
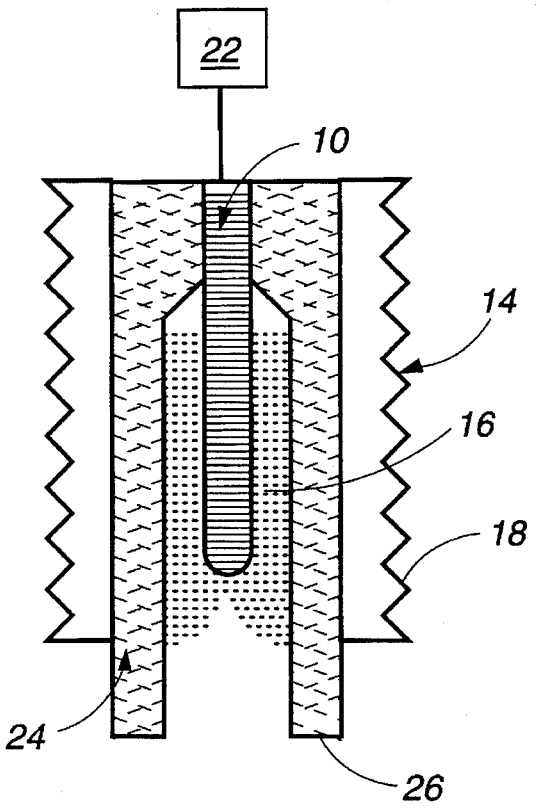
Figure 2B:
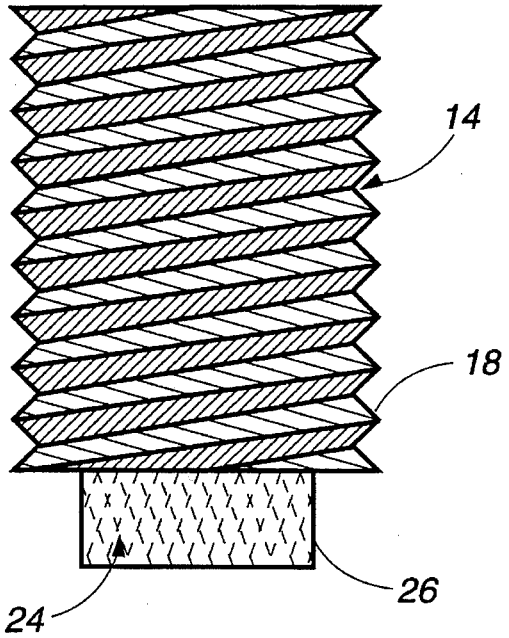

FIGS. 2*a* and 2*b* are schematic representations of a second embodiment of the present invention, FIG. 2*a* showing a cross section thereof. Dielectric barrier 24 is now disposed away from center electrode 10, so that discharge volume 16 is between dielectric barrier 24 and center electrode 10. A portion of the barrier material 26 extends beyond screw portion 18, in order to prevent direct, non-self-limiting discharges from occurring between bare center electrode 10 and bare grounded electrode 14, or along the surface of dielectric barrier 24. This second source of arcing, however, may constitute an additional ignition source initiated by the plasma discharge. The configuration shown permits yet lower voltages to be employed from those of FIGS. 1*a* and 1*b* for the same gas pressure. Moreover, the electric fields within barrier 26 are lower than those in barrier 12 of FIGS. 1*a* and 1*b*. However, this recessed embodiment is likely to be more difficult to fabricate, and gases cannot flow as readily through discharge volume 16. Some relief from this condition may be available by extending center electrode 10, grounded electrode 14, and the dielectric barrier 26 further into the combustion region, longitudinally along the axis of the plug; however, the resultant deepening of discharge volume 16 further impedes the free flow of gas within the annulus.

The foregoing description of the invention has been presented for purposes of illustration and description and is not intended to be exhaustive or to limit the invention to the precise form disclosed, and obviously many modifications and variations are possible in light of the above teaching. For example, it would be apparent to one having ordinary skill in the art after studying the present disclosure, that if only a single pulse is required to ignite a fuel/air mixture, alternating high voltage supply 22 may be replaced with a single-polarity, single-pulse high voltage supply which is similar to those currently employed for ignition systems. This would be the situation if the gases in a cylinder have sufficient conductivity to neutralize the residual charge on the dielectric barrier material after a discharge has taken place. The advantages of having multiple microdischarges and large ignition volume would not be lost, however, with a single-polarity, single-pulse ignition system.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A large discharge-volume, silent discharge spark plug for generating self-terminating microdischarges, which comprises:

a grounded, generally cylindrical first electrode having an open structure;

an elongated second electrode located axially to said first electrode;

a dielectric barrier material covering said second electrode, whereby an annular volume is created between said first electrode and said dielectric barrier material; and means for providing alternating voltage to the second electrode such that self-terminating microdischarges occur between the first electrode and the dielectric material through the annular volume.

2. A large discharge-volume, silent discharge spark plug for generating self-terminating microdischarges, which comprises:

a grounded, generally cylindrical first electrode having an open end;

an elongated second electrode located axially to said first electrode;

dielectric barrier material disposed on the inside cylindrical surface of said first electrode and extending past the open end of said first electrode, whereby an annular volume is created between said dielectric barrier material and said second electrode; and means for providing alternating voltage to the second electrode such that self-terminating microdischarges occur between said second electrode and said dielectric barrier material through the annular volume.

* * * * *